US007106259B2

(12) United States Patent
Tseng et al.

(10) Patent No.: US 7,106,259 B2
(45) Date of Patent: Sep. 12, 2006

(54) PLANAR INVERTED-F ANTENNA

(75) Inventors: Kuo-Hua Tseng, Kaohsiung Hsien (TW); Kuan-Hsing Li, Taichung (TW); Hui-Chung Lee, Taichung (TW); Chuei-Tang Wang, Taichung (TW)

(73) Assignee: University Scientific Industrial Co., Ltd., Nan-Tou Hsien (TW)

( * ) Notice: Subject to any disclaimer, the term of this patent is extended or adjusted under 35 U.S.C. 154(b) by 54 days.

(21) Appl. No.: 10/923,405

(22) Filed: Aug. 20, 2004

(65) Prior Publication Data

US 2006/0038722 A1 Feb. 23, 2006

(51) Int. Cl.
*H01Q 1/24* (2006.01)
*H01Q 13/10* (2006.01)

(52) U.S. Cl. ..... 343/702; 343/700 MS; 343/767

(58) Field of Classification Search ..... 343/700 MS, 343/702, 767

See application file for complete search history.

(56) References Cited

U.S. PATENT DOCUMENTS 6,452,548 B1 * 9/2002 Nagumo et al. ..... 343/700 MS
6,476,769 B1 * 11/2002 Lehtola ..... 343/702
6,624,788 B1 * 9/2003 Boyle ..... 343/702
6,670,925 B1 * 12/2003 Iwai et al. ..... 343/702
6,697,023 B1 * 2/2004 Tiao-Hsing et al. ..... 343/702
6,727,854 B1 * 4/2004 Fang et al. ..... 343/700 MS
6,759,991 B1 * 7/2004 Boyle ..... 343/702
6,822,610 B1 * 11/2004 Yeh ..... 343/700 MS
6,891,506 B1 * 5/2005 Jarmuszewski et al. ..... 343/702
6,933,902 B1 * 8/2005 Yeh ..... 343/762
2001/0050643 A1 * 12/2001 Egorov et al. ..... 343/702
2003/0098813 A1 * 5/2003 Koskiniemi et al. ..... 343/702
2004/0104851 A1 * 6/2004 Kadambi et al. .... 343/700 MS
2004/0150567 A1 * 8/2004 Yuanzhu ..... 343/700 MS
2004/0227678 A1 * 11/2004 Sievenpiper ..... 343/702
2005/0110693 A1 * 5/2005 Ryu ..... 343/702
2005/0122267 A1 * 6/2005 Sim et al. ..... 343/702
2005/0270242 A1 * 12/2005 Qi et al. ..... 343/702

* cited by examiner

*Primary Examiner*—Tan Ho
*Assistant Examiner*—Leith Al-Nazer
(74) *Attorney, Agent, or Firm*—DLA Piper Rudnick Gray Cary US LLP

(57) ABSTRACT

A planar inverted-F antenna includes a ground element, a shorting element, a radiating element, and a feeding element. The shorting element extends upwardly from the ground element. The radiating element is disposed above the ground element, and extends transversely from the shorting element. The radiating element includes a meandering strip and a flat plate. The meandering strip has opposite first and second ends. The first end of the meandering strip is coupled to the shorting element. The flat plate has a connecting side that is connected to the second end of the meandering strip and that has a length different from that of the second end of the meandering strip. The feeding element has a first end that is connected to the radiating element, and a second end that extends through and that is free from electrical contact with the ground element.

3 Claims, 7 Drawing Sheets

PLANAR INVERTED-F ANTENNA

BACKGROUND OF THE INVENTION

1. Field of the Invention

The invention relates to an antenna, more particularly to a planar inverted-F antenna.

2. Description of the Related Art

A conventional planar inverted-F antenna 1, as shown in FIG. 1, includes a ground element 11, a shorting element 12, a radiating element 13, and a feeding element 14. The shorting element 12 extends upwardly from the ground element 11. The radiating element 13 is disposed above the ground element 11, and extends transversely from the shorting element 12, and includes a flat plate 131. The feeding element 14 has opposite first and second ends. The first end of the feeding element 14 is coupled to the flat plate 131 of the radiating element 13. The second end of the feeding element 14 extends through and is free from electrical contact with the ground element 11, and is coupled to a transceiver (not shown).

In operation, a radio signal, which is sent to the transceiver, is fed to the conventional planar inverted-F antenna 1 through the feeding element 11. The fed radio signal is resonated by the conventional planar inverted-F antenna 1 and is radiated externally from the same.

Although the conventional planar inverted-F antenna 1 achieves its intended purpose, since it resonates with the radio signal at a particular frequency dependent upon the size of the flat plate 131 of the radiating element 13, the flat plate 131 of the radiating element 13 of the conventional planar inverted-F antenna 1 may be unacceptably large with certain applications.

SUMMARY OF THE INVENTION

Therefore, the object of the present invention is to further reduce the size of a planar inverted-F antenna so as to overcome the aforesaid drawback of the prior art.

According to the present invention, a planar inverted-F antenna comprises a conductive ground element, a conductive shorting element, a conductive radiating element, and a feeding element. The shorting element extends upwardly from the ground element. The radiating element is disposed above the ground element, extends transversely from the shorting element, and includes a meandering strip and a flat plate. The meandering strip has opposite first and second ends. The first end of the meandering strip is connected to the shorting element. The flat plate has a connecting side that is connected to the second end of the meandering strip, and that has a length different from that of the second end of the meandering strip. The feeding element has a first end that is coupled to the radiating element, and a second end that extends through and that is free from electrical contact with the ground element.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
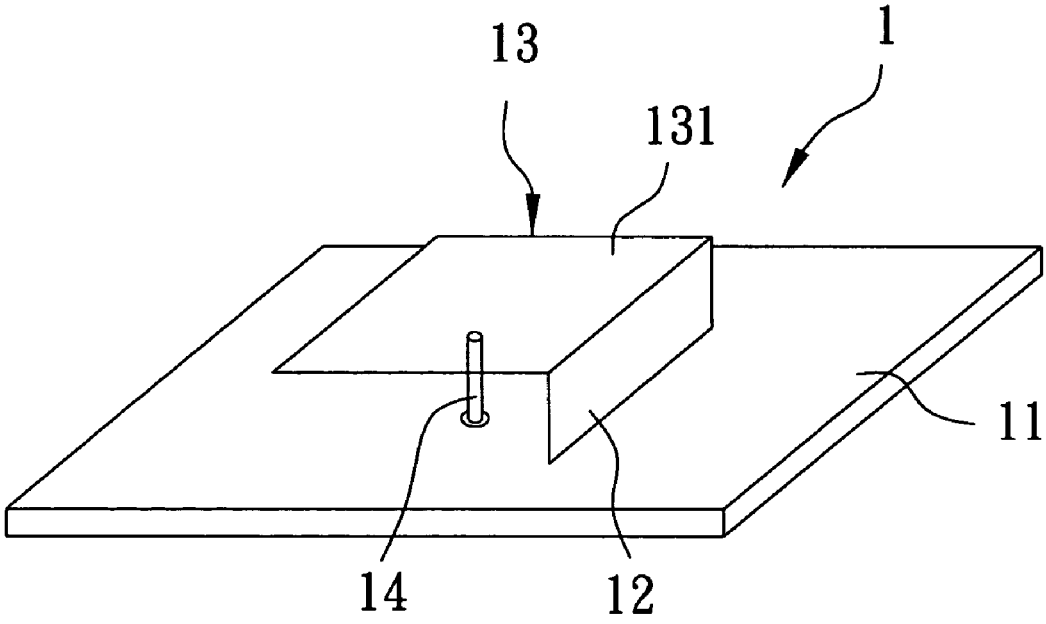
FIG. 1 PRIOR ART
FIG. 1 is a perspective view of the conventional planar inverted-F antenna.

Before the present invention is described in greater detail, it should be noted that like elements are denoted by the same reference numerals throughout the disclosure.

Figure 2:
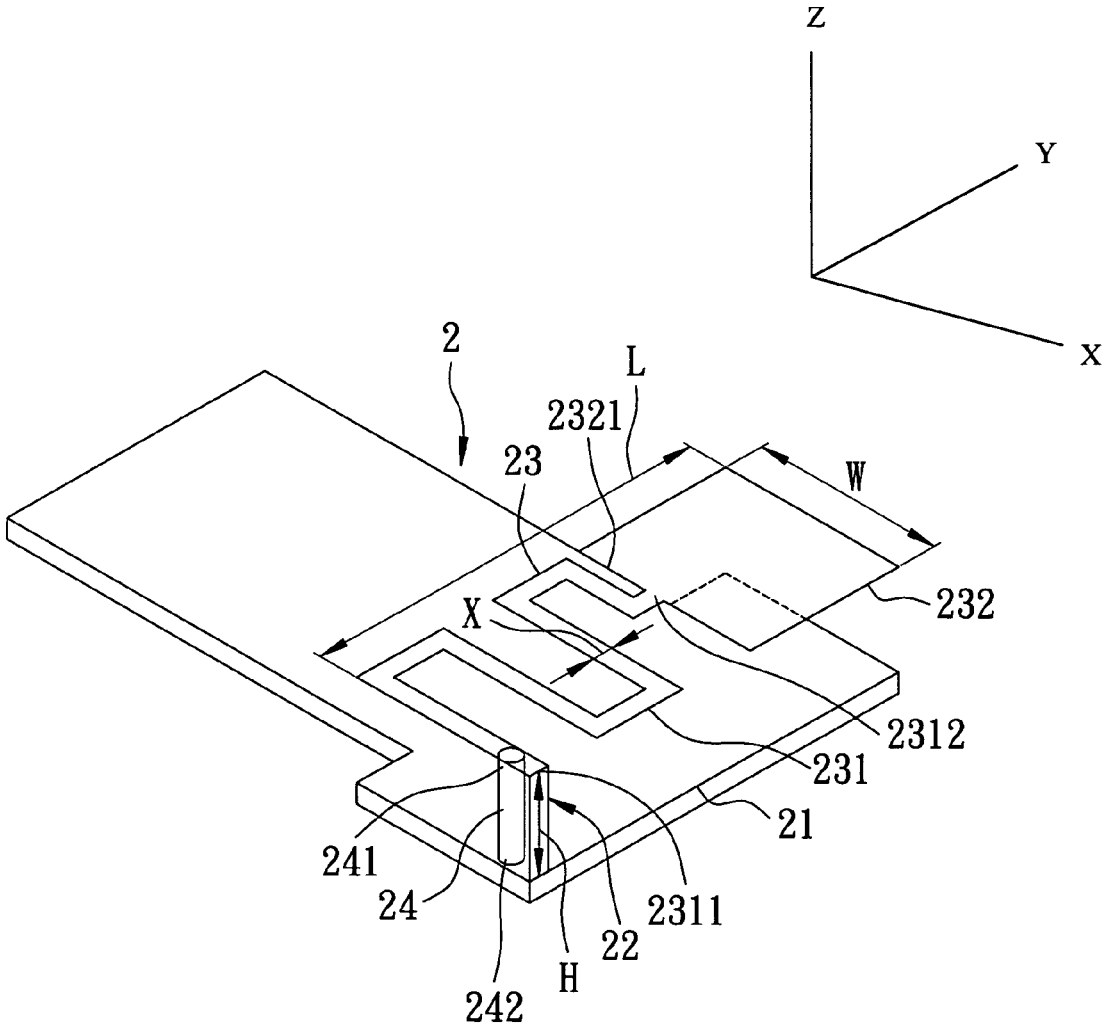
FIG. 2 is a perspective view of the first preferred embodiment of a planar inverted-F antenna according to the present invention.

Referring to FIG. 2, the preferred embodiment of a planar inverted-F antenna 2 according to this invention is shown to include a conductive ground element 21, a conductive shorting element 22, a conductive radiating element 23, and a feeding element 24.

The planar inverted-F antenna 2 of this embodiment is adapted for used in a Bluetooth device (not shown). The Bluetooth device has a space of 5 mm×14 mm×2.5 mm available for an internal antenna. Therefore, the planar inverted-F antenna 2 of this invention is required to have overall dimensions such that it can be embedded within the given space, and at the same time, cover the Bluetooth bandwidth requirement of 2402 MHz to 2480 MHz centered around an operating frequency.

In this embodiment, the ground element 21 is made from metal, such as gold. Alternatively, the ground element 21 may be made from copper or other conductive materials.

The shorting element 22 extends upwardly from the ground element 21. In this embodiment, the shorting element 22 is made from metal, such as gold, copper, or other conductive materials.

The radiating element 23 is disposed above the ground element 21, extends transversely from the shorting element 22, and includes a meandering strip 231 and a first flat plate 232. In this embodiment, the radiating element 23 is made from metal, such as gold, copper, or other conductive materials.

It is noted that increasing the distance of the radiating element 23 above the ground element 21 will increase the operating bandwidth of the planar inverted-F antenna 2 of this invention. Thus, given the required operating bandwidth, the shorting element 22 is adjusted accordingly. In this embodiment, the shorting element 22 has a height (H) of 2.5 millimeters with respect to the ground element 21.

The meandering strip 231 has a first end 2311 connected to the shorting element 22, and a second end 2312 opposite to the first end 2311 of the meandering strip 231. The meandering strip 231 includes bends, each of which defines a right angle. In this embodiment, the meandering strip 231 includes six bends, and has a uniform width (X). It is noted that the shorting element 22 has a width that is preferably equal to that of the meandering strip 231.

The first flat plate 232 is substantially rectangular, and has a connecting side 2321 that is connected to the second end 2312 of the meandering strip 231 and that has a length different from that of the second end 2312 of the meandering strip 231. In this embodiment, the length of the connecting side 2321 of the first flat plate 232 is greater than that of the second end 2312 of the meandering strip 231. As shown in FIG. 2, the meandering strip 231 has an end portion that defines the second end 2312 of the meandering strip 231 and that is perpendicular to the connecting side 2321 of the first flat plate 232. It is noted that the difference in length between the second end 2312 of the meandering strip 231 and the connecting side 2321 of the first flat plate 232 results in a discontinuity in electrical property, which produces an inductance that alters electric field distribution across the radiating element 23. It is further noted that each of the meandering strip 231 and the first flat plate 232 has distinct characteristic impedance.

The feeding element 24 has opposite first and second ends 241, 242. The first end 241 of the feeding element 24 is coupled to the meandering strip 231 of the radiating element 23. The second end 242 of the feeding element 24 extends through and is free from electrical contact with the ground element 21, and is coupled to a transceiver (not shown). In this embodiment, the feeding element 24 has an input impedance of 50 Ohms.

It is noted that the operating frequency of the radiating element 23 is directly proportional to the ratio of the length of the second end 2312 of the meandering strip 231 to the length of the connecting side 2321 of the first flat plate 232. It is also noted that the meandering strip 231 has the effect of increasing electrical path without increasing the physical size of the same. Thus, given an operating frequency, the relative ratio of the length of the second end 2312 of the meandering strip 231 to the length of the connecting side 2321 of the first flat plate 232, and the effective length of the meandering strip are adjusted accordingly. Once adjusted, a suitable length (L) and width (W) of the radiating element 23 can be determined. In this embodiment, since the Bluetooth device reserves a 5 mm×14 mm×2.5 mm space for an internal antenna, the radiating element 23 has a length (L) of 14 millimeters and a width (W) of 5 millimeters.

Figure 3:
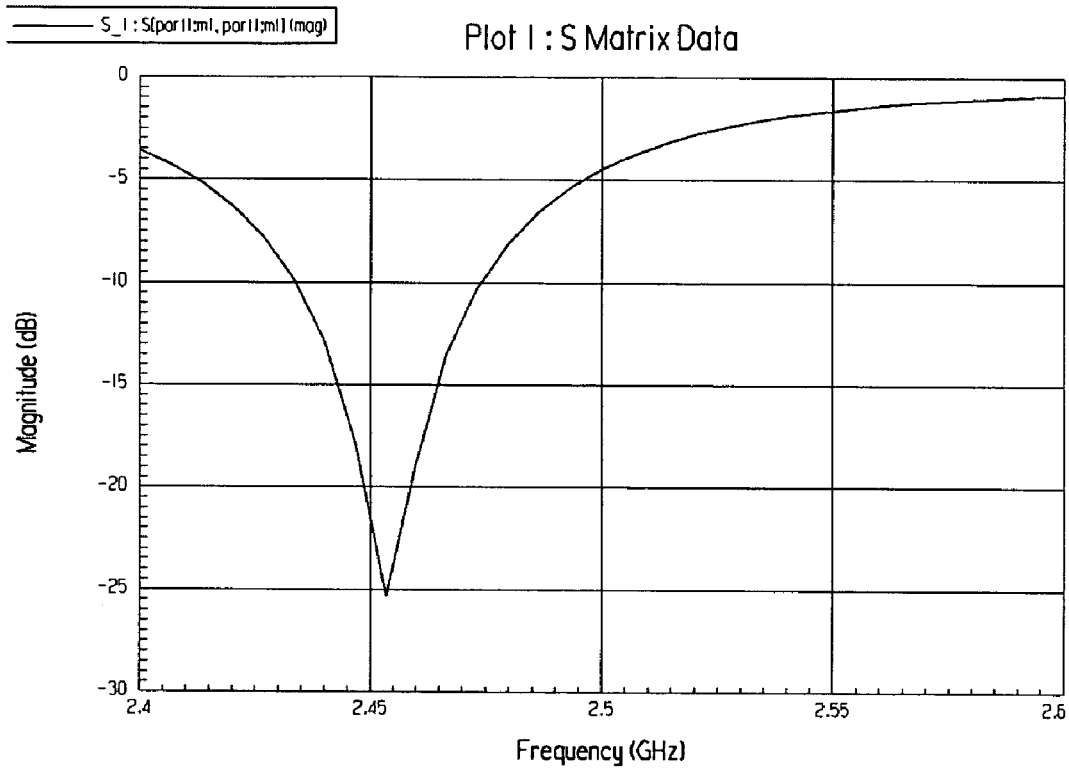
FIG. 3 is a graph illustrating simulated return loss of the first preferred embodiment
Figure 4:
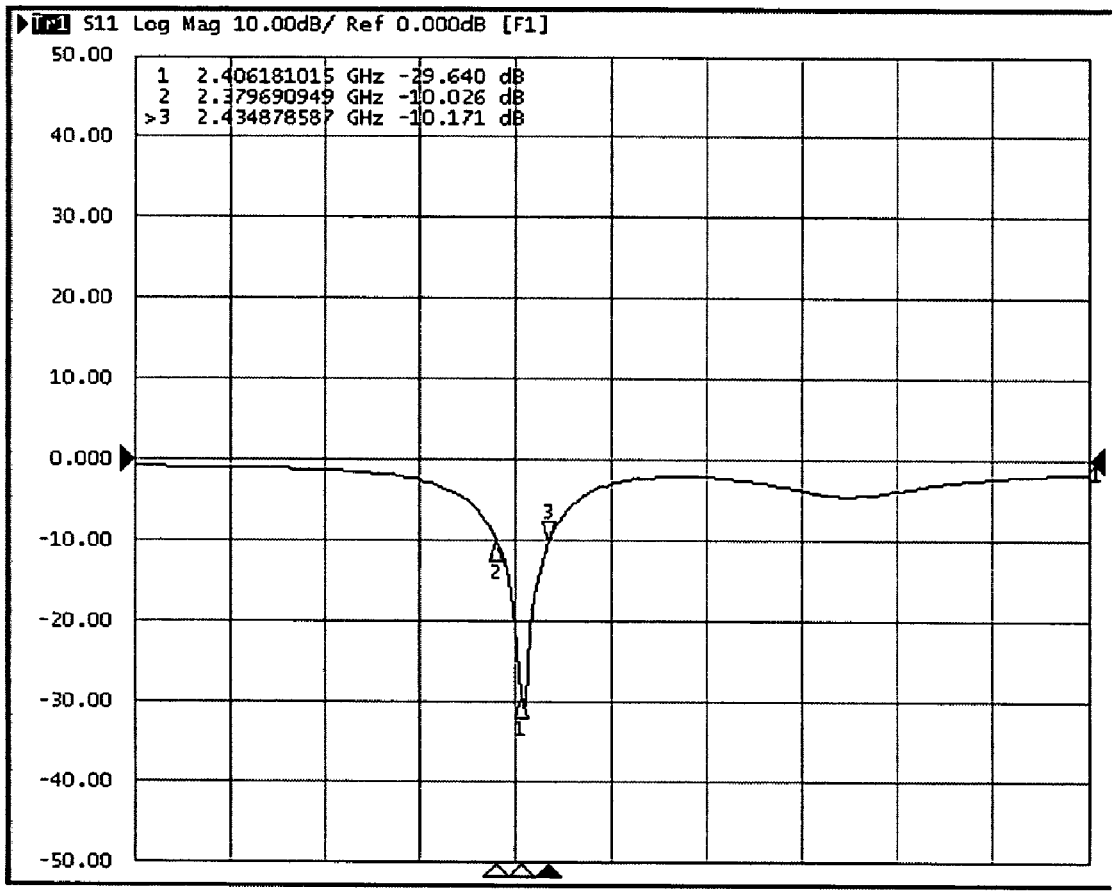
FIG. 4 is a graph illustrating an actual return loss of the first preferred embodiment.

FIGS. 3 and 4 show the simulated and actual return losses of the planar inverted-F antenna 2 of this invention, respectively. Indeed, the planar inverted-F antenna 2 of this invention has its operating frequency centered within the 2402 MHz and 2480 MHz bandwidth in compliance with the Bluetooth bandwidth requirement.

Figure 5:
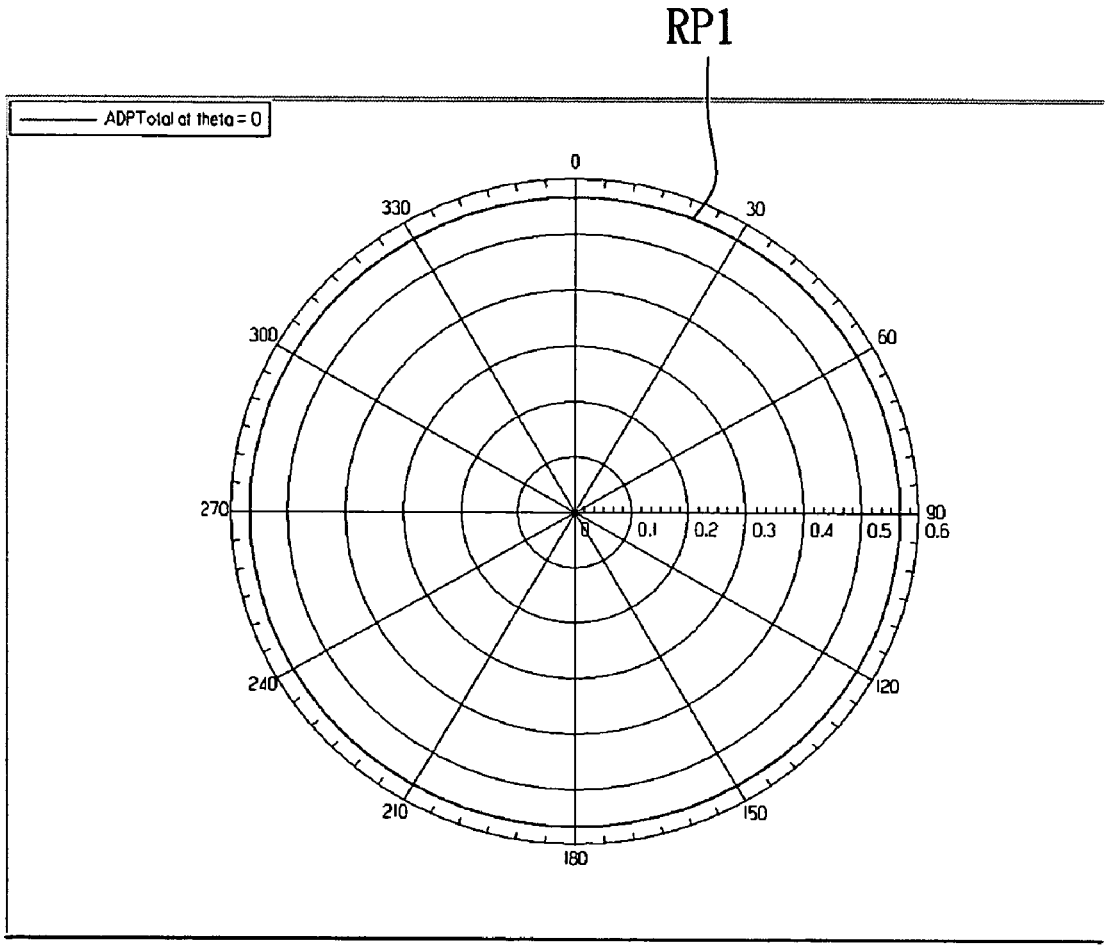
FIG. 5 is a graph illustrating a simulated radiation pattern of the first preferred embodiment in an x-y plane.
Figure 6:
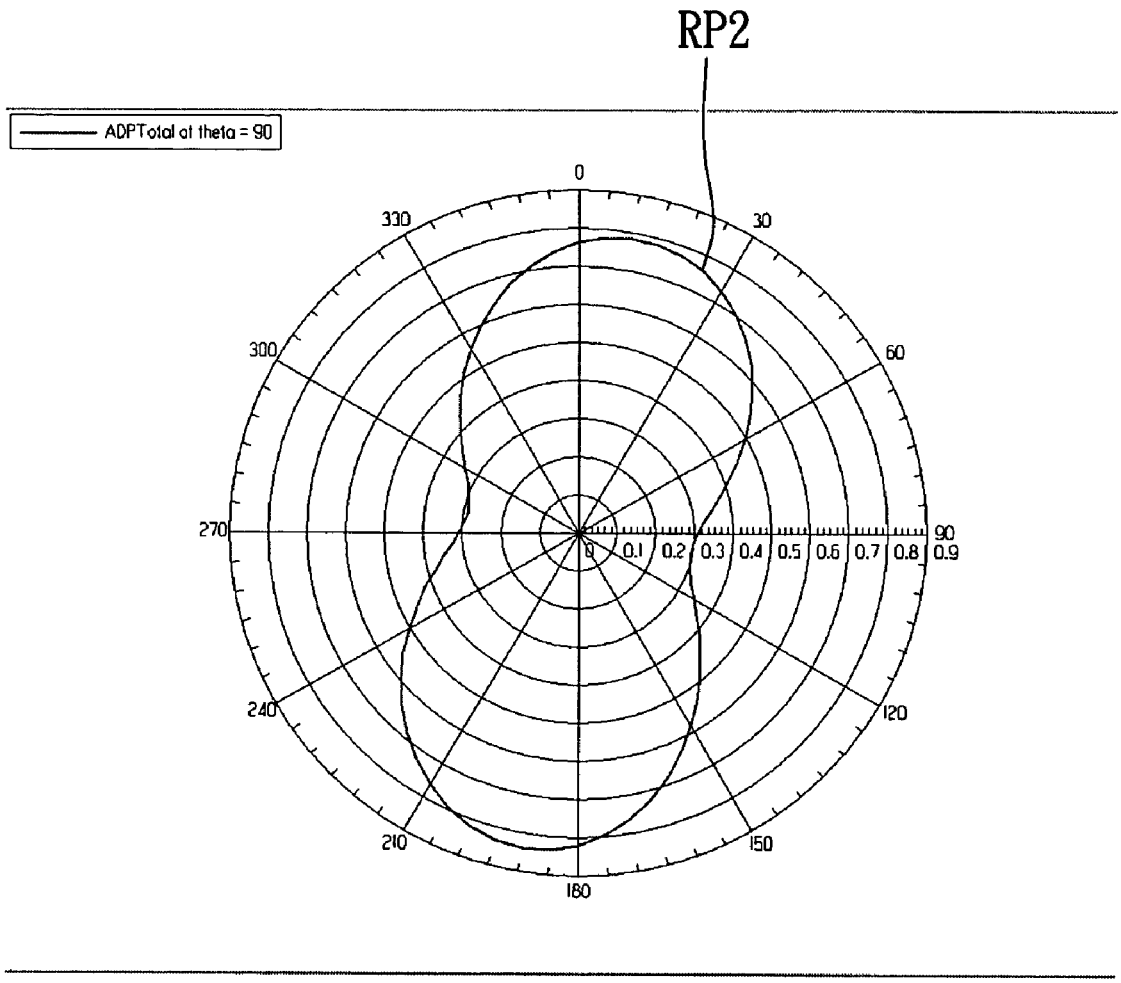
FIG. 6 is a graph illustrating a simulated radiation pattern of the first preferred embodiment in an x-z plane.

FIG. 5 shows a simulated radiation pattern (RP1) of the planar inverted-F antenna 2 of this invention in an x-y plane parallel to the conductive radiating element 23 (see FIG. 2). Moreover, FIG. 6 shows a simulated radiation pattern (RP2) of the planar inverted-F antenna 2 of this invention in an x-z plane transverse to the x-y plane (see FIG. 2). Indeed, the planar inverted-F antenna 2 of this invention has a satisfactory directivity.

From the above description, the planar inverted-F antenna 2 of this invention can be operated in different operating frequencies by adjusting both the ratio of the length of the second end 2312 of the meandering strip 231 to the length of the connecting side 2321 of the first flat plate 232, and the length of the meandering strip 231. Therefore, the overall area occupied by the planar inverted-F antenna 2 of this invention may be reduced as required.

Figure 7:
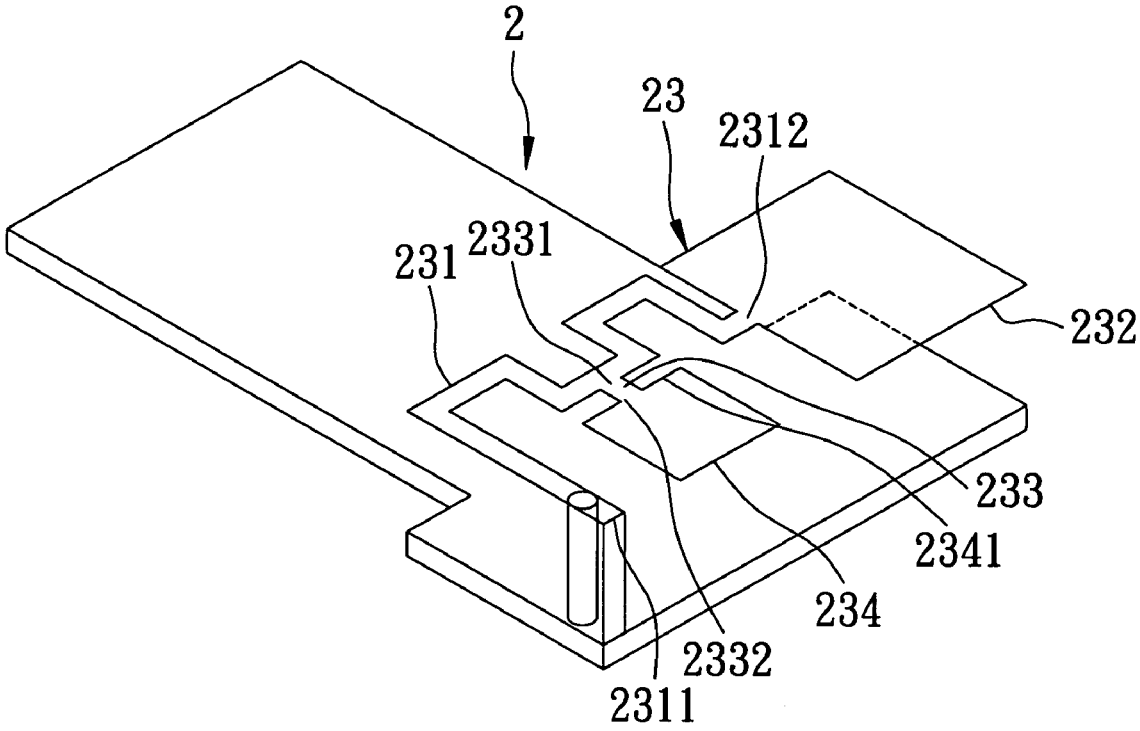
FIG. 7 is a perspective view of the second preferred embodiment of a planar inverted-F antenna according to the present invention.

FIG. 7 illustrates the second preferred embodiment of a planar inverted-F antenna 2 according to this invention. When compared to the previous embodiment, the radiating element 23 further includes a connecting piece 233 and a second flat plate 234.

The connecting piece 233 extends from the meandering strip 231 at a position between the first and second ends 2311, 2312 of the meandering strip 231, and has a first end 2331 connected to the meandering strip 231, and a second end 2332 opposite to the first end 2331 of the connecting piece 233.

The second flat plate 234 extends from the connecting piece 233, and has a connecting side 2341 that is connected to the second end 2332 of the connecting piece 233, and that has a length different from that of the second end 2332 of the connecting piece 233. In this embodiment, the length of the connecting side 2341 of the second flat plate 234 is greater than that of the second end 2332 of the connecting piece 233. As shown in FIG. 6, the connecting piece 233 is perpendicular to the connecting side 2341 of the second flat plate 234.

As in the previous embodiment, the ratio of the length of the second end 2332 of the connecting piece 233 to the length of the connecting side 2341 of the second flat plate 234 can be adjusted so as to operate the radiating element 23 at a desired resonance frequency.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A planar inverted-F antenna comprising:

a conductive ground element;

a conductive shorting element extending upwardly from said ground element; and a conductive radiating element disposed above said ground element, and extending transversely from said shorting element, said radiating element including a meandering strip that has apposite first and second ends, said first end of said meandering strip being connected to said shorting element, a first flat plate that has a connecting side which is connected to said second end of said meandering strip, a feeding element having a first end that is coupled to said radiating element, and a second end that extends through and that is free from electrical contact with said ground element, a connecting piece that extends from said meandering strip at a position between the first and second ends of said meandering strip, and that has a first end connected to said meandering strip, and a second end opposite to said first end of said connecting piece; and a second flat plate that extends from said connecting piece, said second flat plate having a connecting side that is connected to said second end of said connecting piece.

2. The planar inverted-F antenna as claimed in claim 1, wherein said meandering strip includes bends, each of which defines a generally right angle.

3. The planar inverted-F antenna as claimed in claim 1, wherein said shorting element has a width that is substantially equal to that of said meandering strip.

* * * * *